US006612377B2

(12) United States Patent
Rynard

(10) Patent No.: US 6,612,377 B2
(45) Date of Patent: Sep. 2, 2003

(54) SCRAPER TOOL

(76) Inventor: Kenneth O. Rynard, 14108 E. 253 St., Peculiar, MO (US) 64078

( * ) Notice: Subject to any disclaimer, the term of this patent is extended or adjusted under 35 U.S.C. 154(b) by 0 days.

(21) Appl. No.: 09/974,370

(22) Filed: Oct. 10, 2001

(65) Prior Publication Data

US 2003/0066662 A1 Apr. 10, 2003

(51) Int. Cl.[7] ..... E02F 3/04; E21F 37/00; E21F 37/02

(52) U.S. Cl. ..... 172/25; 37/258; 37/189; 175/20; 175/308

(58) Field of Search ..... 172/25, 120, 119, 172/123, 122; 37/258, 189; 30/DIG. 7; 405/231, 232, 246; 73/864.44, 864.45; 175/58, 20, 226, 248, 249, 308, 300

(56) References Cited

U.S. PATENT DOCUMENTS 1,102,078 A * 6/1914 Riggs ..... 175/6
3,081,635 A * 3/1963 Bowers ..... 73/864.44
3,405,772 A * 10/1968 Wisenbaker et al. ..... 175/77
3,440,886 A * 4/1969 Meeker ..... 175/170
3,596,723 A * 8/1971 Elenburg ..... 175/95
3,951,212 A * 4/1976 Hallman ..... 172/19
4,043,407 A * 8/1977 Wilkins ..... 175/50
5,133,269 A * 7/1992 Charneski ..... 111/116
5,938,290 A * 8/1999 Mikeska ..... 30/300
6,311,782 B1 * 11/2001 Plasek et al. ..... 172/13

* cited by examiner

*Primary Examiner*—David Bagnell
*Assistant Examiner*—Alexandra K. Pechhold
(74) *Attorney, Agent, or Firm*—Spencer Fane Britt & Browne LLP

(57) ABSTRACT

An excavation cleaning tool or dredge is provided which rotates and scrapes together and captures the loose soil, sand and gravel debris at the bottom of the hole to provide a clean, flat-bottomed hole which is free of compressible excavation waste material.

6 Claims, 2 Drawing Sheets

SCRAPER TOOL

TECHNICAL FIELD

The present invention relates to excavation tools. In particular, the present invention provides a means of capturing and removing dirt debris and gravel debris from the bottom of cylindrical excavations used for construction footings by use of a cleaning tool or dredge which rotates to scrape together and capture the loose soil, sand and gravel debris at the bottom of the hole to provide a clean, flat-bottomed hole which is free of compressible excavation waste material.

BACKGROUND OF THE INVENTION

In the construction of houses, buildings or deck structures added to houses, it is a common requirement that excavations for concrete footings be provided at spaced intervals to support the construction. The general types of footings that are used are spread footings, pad footings, and wood pier footings, and concrete column footings. Spread footings are simply a wide-base footing which is used to distribute the weight of the structure and foundation over a larger portion of the ground. In modern construction, a spread footing is usually 16–24 inches wide and 6–16 inches thick and made of poured concrete. The dimensions of the footing will vary according to the soil conditions under the structure and the amount of weight that is being placed on the footing and the construction style of the building.

Another type of footing is the pad footing. A pad footing is similar to a spread footing but it is usually limited to spreading the force or weight of a single support or contact point. A pad footing may be used under a pier or post and is typically a 2 foot by 2 foot square pad with a thickness of 10–12 inches. Pad footings are usually of poured concrete. In modern construction, pad footings are frequently used with lightweight decks and stable soil conditions.

The type of footing which is used with heavier buildings or buildings that are to be placed on unstable soils is concrete column footing. The concrete column footing is constructed by first drilling a cylindrical hole into the ground until rock or other suitable stable substrate is encountered. Such concrete piers are typically used in areas where other footing types are not desirable due to poor soil quality or where there is a high water table.

During the excavation of the cylindrical hole for the concrete pier, it is typical that an auger-type bit will be used to rapidly drill through the earth until bedrock or other suitable solid substrate is encountered. Once the hole has been drilled, it is necessary that the bottom of the hole be cleared of all loose sand, gravel and dirt, and that a clean, solid surface be presented for the concrete to contact. The removal of compressible soil and other drilling waste left behind by the auger is critical to a stable column footing. If the compressible dirt and waste is not removed from the excavated hole, this material will eventually compress after the concrete is poured into the hole. Such compacting of compressible materials may not occur immediately or completely when the concrete is poured into the hole and compression of the material and settling of the concrete pier may occur after construction has been completed. Such settling of the concrete pier can be disastrous to the construction resting upon the concrete pier. The settling of a concrete pier by even one-half inch could result in severe crack in a concrete basement floor or substantial settling of the structure residing on the concrete causing cracks in walls and jammed doors and windows.

For insurance purposes, and before concrete is poured into the hole, a soil engineer is usually consulted for approval of the holes. The engineer will inspect all holes before concrete is poured and make a mapped report on all hole depths, the number of piers, how clean the hole are at the bottoms, which holes were dug, the type of soil at the hole bottom, and the diameter of the piers. Before concrete is poured for the structure, all holes for piers must pass these daily inspections.

In the prior art, to clear such compressible debris from excavated cylindrical holes, it has been the typical procedure to clean out the compressible materials and debris by hand. For shallow and narrow holes, this has been accomplished by using a post hole digger or a long handled shovel which allows the worker to reach to the bottom of the hole and retrieve the loose dirt and other waste materials. In the case of larger diameter excavations, workers have been known to engage in the extremely unsafe practice of going down into the excavated footing hole to clear the loose dirt and compressible material by hand. This procedure is extremely dangerous as the sidewalls of the newly excavated hole are not supported by shoring of the walls. Such shoring is needed to prevent the collapse of the hole on a worker within the excavated hole. Many times a year, workers are suffocated to death by working in trenches which have not had any shoring applied to the sidewalls of the trench. This same type of collapse can occur with auger excavated holes intended for concrete piers. The risk of such a collapse should be avoided at all costs.

Yet another drawback of the conventional means of clearing compressible dirt and debris from the bottom of augured concrete pier excavation holes is the cost of accomplishing the cleaning of the hole. Depending on the size and depth of the hole, it can take a single person from 20–30 minutes to hand-clean the bottom surface of a hole. For example, it is possible using a 24-inch diameter auger attached to a skid-steer tractor to drill 21 footing holes six feet deep in well-packed clay within a five hour period of time. This period of time includes the moving of the loose dirt away from each hole and into a waste pier. A quickly working person hand-cleaning each hole would require approximately 20 minutes. For the 21 holes of the present example, nearly seven hours would be required to clean the holes. Therefore it can be appreciated that substantial time and cost is involved in cleaning the compressible debris from footing holes.

Yet another problem associated with hand-cleaning of dirt and compressible debris from footing holes is the time requirements associated with drilling the hole, cleaning the hole, and filling the hole with concrete. To minimize time and effort, it is preferred that the footing holes be drilled, cleaned and filled with concrete before the end of the work day. For practical purposes, this means that the holes must be drilled and cleaned prior to about 2 o'clock in the afternoon so the concrete can be scheduled to arrive and poured into the holes before it is time to quit for the day. If the augured footing holes are not filled with concrete prior to the end of the day, it is necessary for safety reasons to cover each hole with an immovable cover. Typically such a cover would be a 3 foot by 3 foot sheet of plywood, which is then weighted down by a mound of dirt to prevent children or others who might wander onto the construction site from removing the cover and falling into the hole and being trapped or buried in the hole should the sidewalls collapse. Therefore, a need exists for a device or tool which can be extended into the freshly auger-drilled footing hole to gather and capture the loose dirt and compressible debris which remains in the hole after it is drilled with a convention auger bit.

Further, a need exists for a device which can be inserted into a freshly augured hole to clean the compressible debris from the hole which can be rapidly and efficiently operated to reduce the time needed to scrape together the loose debris at the bottom of the hole and to provide a clean surface at the bottom of the hole for receiving concrete.

Further, a need exists for a tool which can be placed into a freshly augured footing hole which can be attached to the auger drilling device in place of or on the end of the auger bit and accomplish the cleaning of the hole utilizing the same device and personnel which was used to auger drill the hole.

SUMMARY OF THE INVENTION

The above problems are solved and needs fulfilled by the present invention which provides a circular plate having an opening therein and a scraper blade extending therethrough which can be lowered into an augured hole of the proper diameter and rotated therein to scrape together and capture the loose compressible dirt and material at the bottom of the hole. The plate may or may not have a sideall attached thereto which extends upwardly from the plate and serves as a retaining wall for assisting and capturing the loose dirt and material which has been scraped onto the plate during rotation of the plate in the hole and to allow the loose dirt and material to be withdrawn from the hole as the tool is withdrawn from the hole. It is a further benefit if the plate is provided with a replaceable and depth-adjustable blade as well as an adjustable plate which can be used to vary the size of the opening in the plate to allow greater or smaller amounts of material to be scraped up onto the plate and to reduce the amount of material which can fall back through the hole in the plate and into the floor of the excavated hole.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DETAILED DESCRIPTION

Figure 1:
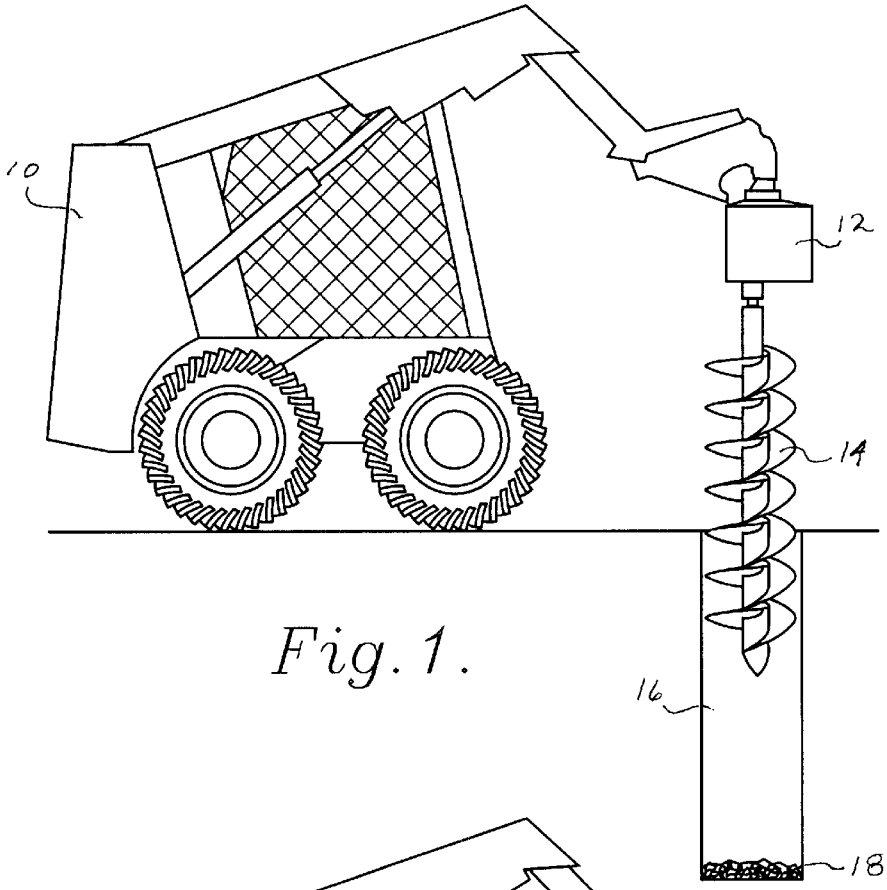
FIG. 1 shows a typical skid-steer tractor device having an auger drilling attachment affixed thereto which has been used to drill a typical cylindrical footing hole and which hole presents an amount of dirt, debris and other compressible material remaining in the bottom of the hole as the auger bit is withdrawn.

Referring now to FIG. 1, a skid-steer tractor 10 is shown with an auger driver attachment 12 connected to skid-steer tractor 10 and an auger blade 14 inserted in auger driver 12. In FIG. 1, tractor 10 and the connected apparatus has been utilized to excavate hole 16 which is a generally round hole intended for filling with concrete for use as a support footing for construction. As is shown in FIG. 1, at the conclusion of the auguring or drilling of hole 16 with auger blade 14, a certain amount of soil residue and other compressible drilling debris 18 remains at the bottom of hole 16. It is this debris which must be removed from hole 16 as the soil debris such as dirt, sand, gravel, etc., is generally compressible under the weight of the concrete which will be poured into hole 16. As previously described, soil debris 18 will not necessarily immediately compact under the weight of the wet concrete, but can later compact causing a shifting or settling of the concrete poured into hole 16. Such settling is, as previously described, a substantial debility for construction.

Figure 2:
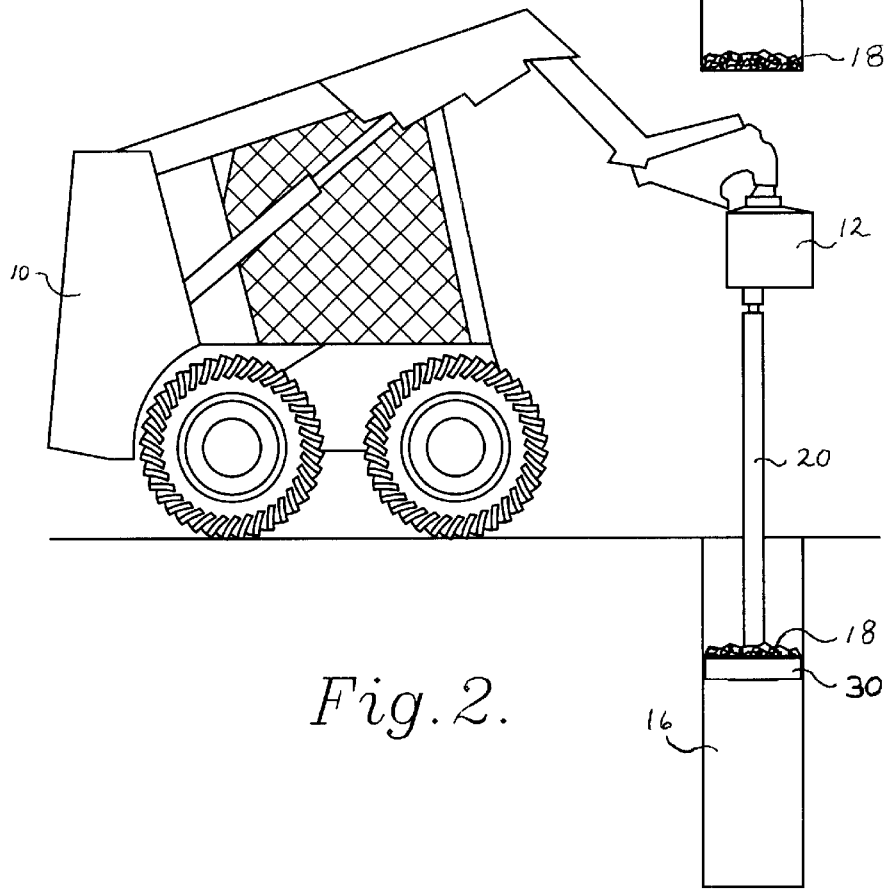
FIG. 2 is a side elevation view showing the use of the present invention within the excavation hole of FIG. 1 and the extension of the present invention into the hole for scraping together the loose debris and which has been captured in the invention so that the debris and dredging bit of the present invention can be simultaneously removed to leave a clean surface at the bottom of the excavated hole.

Referring now to FIG. 2, the general use of the present invention is shown in the context of the operating environment. Again, a skid-steer tractor 10 is equipped with an auger driver attachment 12 and to which is attached an extension or connection rod 20. At the lower end of extension rod 20 is an embodiment of the present invention 30 (FIG. 3), 51 (FIG. 5) which has been inserted into hole 16, previously excavated by auger blade 14 (FIG. 1). It will be appreciated by those skilled in the art that the present invention 30, 51 may alternatively be attached to the end of auger 14 (FIG. 1) as a substitute for connection rod 20.

In FIG. 2 scraper or dredge 30, 51 is being removed from hole 16 after performing its task as is indicated by the capture of debris 18 in scraper or dredge 30, 51. In FIG. 2 debris 18 in scraper or dredge is being removed from hole 18 as dredge 30, 51 is withdrawn from hole 16.

In the course of operation of the present invention, the scraper or dredge 30, 51 was inserted into the bottom of hole 16 whereupon it was rotated by auger driver 12 and the compressible debris 18 residing at the bottom of hole 16 as shown in FIG. 1 was scraped together by dredge 30, 51 and captured by the dredge. The compressible debris 18 now resides within scraper 30, 51 and can be withdrawn from hole 16 leaving a hole bottom which is free of unwanted compressible soil and debris 18 and generally scraped clean and into a solid and level condition which is mandatory for a Soil Engineer to pass inspection prior to receiving concrete.

Figures 3, 4, 5, 6, 7:
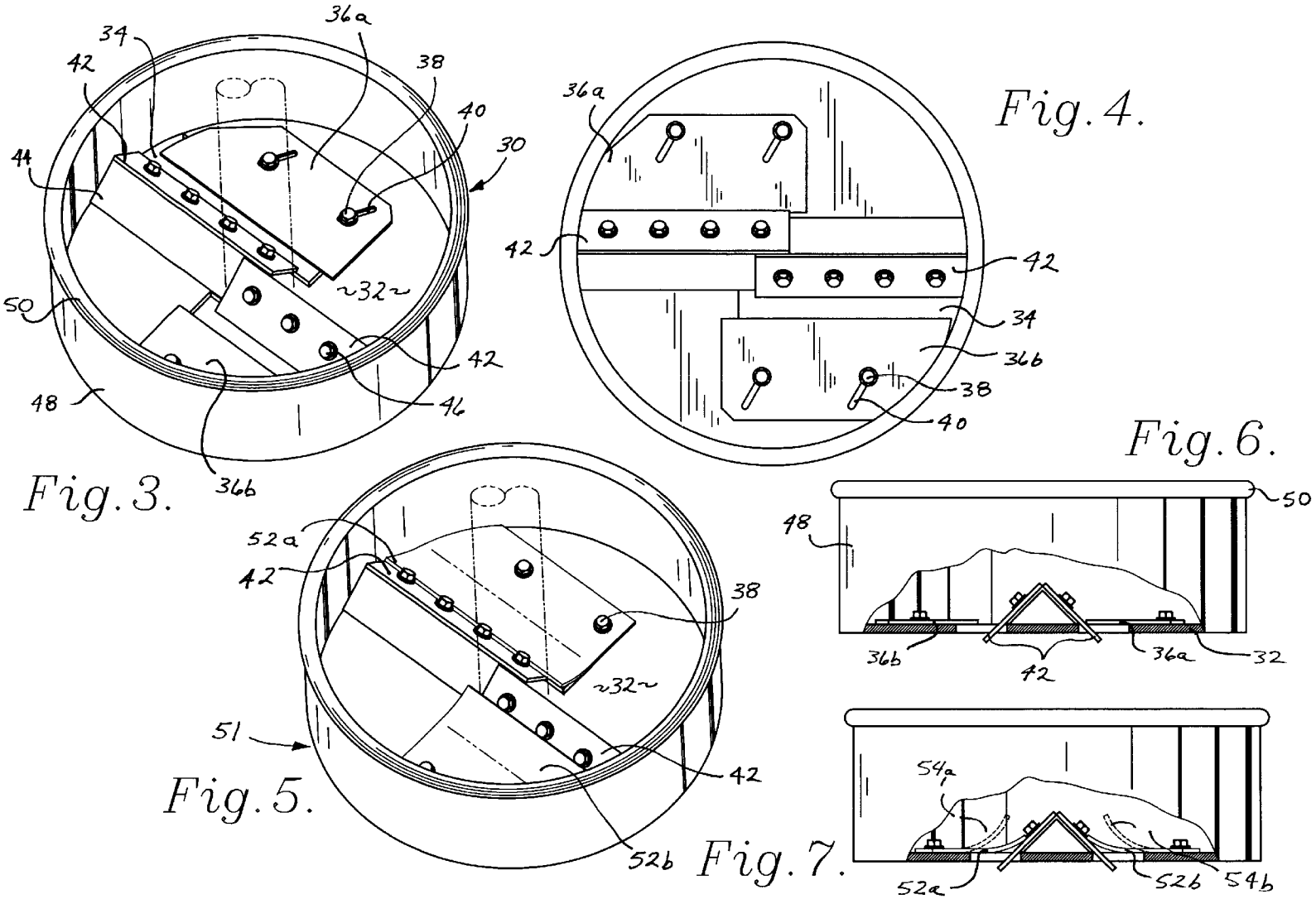
FIG. 3 is a top and side perspective view of a preferred embodiment of the present invention.
FIG. 4 is a plan view of the embodiment of FIG. 3 and showing one gap plate fully open and one gap plate fully closed.
FIG. 5 is a top and side perspective view of an alternative embodiment of the present invention having a flexible flap covering the gap in the bottom plate.
FIG. 6 is an side elevational view of the embodiment of FIG. 3 with a portion of the sidewall removed to reveal a cross-section of the bottom plate gap, the gap plates and the scraper blades.
FIG. 7 is an side elevational view of the embodiment of FIG. 5 with a portion of the sidewall removed to reveal a cross-section of the bottom plate gap, the flexible flap and the scraper blades.

Referring now to FIG. 3, the scraper or dredge 30, 51 shall be more particularly described. In FIG. 3 an embodiment of the present invention is shown in perspective view and showing in phantom lines the locality for connection of extension or connection rod 20 (FIG. 1). The embodiment shown in FIG. 3 of scraper or dredge 30 is formed by equipping a bottom plate 32 with at least one void or aperture 34 in plate 32. Void or aperture 34 is present so that as scraper or dredger 30 is rotated within a hole 16 (FIG. 2) soil debris 18 can pass therethrough for capture within scraper dredger 30. In the embodiment shown in FIG. 3, void or aperture 34 is able to be increased or decreased in size through the use of gap plate 36 which is movably mounted onto bottom plate 32 by bolts 38 passing through apertures 40 in plate 36 to connect into threaded voids within bottom plate 32.

Blades 42 are connected to blade support 44 by bolts 46 which pass through voids in blades 42 (not shown) to connect into threaded voids within blade support 44. Blade support 44 provides a proper angle for blades 42. The proper angle being such that blades 42 provide a scrapping or dredging action as they contact the bottom of hole 16 and provide little in the way of a cutting action which would serve to substantially increase the depth of a hole 16 as previously determined by the use of auguring blade 14 (FIG. 1). Again referring to FIG. 2, as scraper or dredger 30 is rotated within a hole 16, the loose soil and debris 18 at the bottom of hole 16 (FIG. 1) will be confronted by blades 42 mounted in dredge 30. Blades 42 cause the loose soil and debris 18 to be forced upwardly and into scraper dredger 30. As more loose soil 18 is confronted by blade 42, the additional soil and debris 18 will be pushed into scraper dredger 30 and will be contained within scraper dredger 30 by side wall 48 which is connected to bottom plate 32. On the top edge of side wall 48 is rim 50 which is a rod of material which has been bent to conform to the circular shape of side wall 48 and has been welded thereto. Rim 50 serves to slightly space side wall 48 from the sides of hole 16 and to generally limit the contact between scraper dredger 30 and the sides of hole 16 to the contact between rim 50 and the sides of hole 16. This limited contact between scraper dredger 30 and the sides of hole 16 serves to reduce the amount of loose and compressible soil and debris 18 which is knocked off the sides of hole 16 during entry and removal of scraper dredger 30 from hole 16. In addition rim 50 serves to prevent sidewall 48 from digging into the sides of the pier hole when the dredger 30, 51 is being extracted from the hole.

Referring now to FIG. 4, a plan view of the embodiment of FIG. 3 is shown. In FIG. 4, the adjustability of plates 36*a*, 36*b* is shown. Plate 36*a* is in a completely closed position such that no space exists between plate 36*a* and blade 42 and, therefore, void or aperture 34 is sealed. In contrast, plate 36 is fully open as indicated by the position of bolts 38 in adjusting slots 40 thus retracting blade 36*b* fully away from blade 42 and exposing the maximum area of aperture 34 that is permitted by the length of adjusting slots 40.

Referring now to FIG. 5, an alternative embodiment is shown in which plates 36*a*, 36*b* have been replaced by flexible flaps 52*a*, 52*b*. Flexible flaps 52*a*, 52*b* are attached to bottom plate 32 by bolts 38 which are screwed into threaded voids (not shown) in bottom plate 32. In use, flexible flaps 52*a*, 52*b* rest against blades 42 until the embodiment of FIG. 5 contacts debris 18 in the bottom of hole 16 (FIG. 1). As scraper 51 is rotated in a hole 16 (FIG. 2) and lowered to contact debris 18 at the bottom of the hole 16 (FIG. 1) blade 42 contacts the debris 18 and forces the debris upwardly. The pressure of the debris against flap 52*a*, 52*b* forces the flap into an open position 54*a*, 54*b* (FIG. 7) and the debris is captured within scraper 51. It will be appreciated by those skilled in the art that flexible flaps 52*a*, 52*b* can be constructed from any suitable strong, resilient material such as rubber or nylon or other plastic.

Referring now to FIG. 6, the extension of blades 42 is shown with respect to bottom plate 32. Blades 42 generally extend below bottom plate 32 by approximately one-quarter inch to approximately 2 inches. Greater lengths of blades 42 extending below bottom plate 32 tend to unnecessarily increase the amount of additional downward cutting in hole bottom 16 rather than increasing the scraping up of debris.

It will be appreciated that blades 42, in an alternative embodiment could simply be a downwardly bent portion of bottom plate 32 that is positioned in the location of blades 42 shown in FIGS. 3–7.

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted a limiting, but merely as a basis for the claims and as a representative basis for teaching one skilled in the art to variously employ the present invention in virtually any appropriately detailed structure.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

It is also to be understood that the following claims are intended to cover all of the generic and specific features of the invention herein described, and all statements of the scope of the invention which, as a matter of language, might be said to fall there between.

Having thus described the invention, what is claimed as new and desired to be secured by Letters Patent is as follows:

1. A dredge for collecting debris from an augured hole comprising:

a generally horizontally extending bottom plate having upper and lower faces, a void in said bottom plate, a gap plate for varying the size of said void, said gap plate comprises a flexible flap, and a blade mounted on said bottom plate said blade extending through said void to direct debris adjacent said bottom plate lower face through said void and onto said bottom plate upper face.

2. The dredge as claimed in claim 1 further comprising a side wall extending upwardly from said bottom plate.

3. A dredge for collecting debris from an augured hole comprising:

a generally horizontally extending bottom plate having upper and lower faces, a void in said bottom plate, a gap plate to vary the size of said void, and a blade mounted on said bottom plate said blade extending through said void to direct debris adjacent said bottom plate lower face through said void and onto said bottom plate upper face.

4. The dredge as claimed in claim 3 further comprising a side wall extending upwardly from said bottom plate.

5. A dredge for collecting debris from an augured hole comprising:

a bottom plate having upper and lower faces, a side wall extending upwardly from said bottom plate, a void in said bottom plate, a blade mounted on said bottom plate said blade extending through said void to direct the debris adjacent said bottom plate lower face through said void, and a flexible flap biased against said blade said flap being forced into an open position by said directed debris to allow the passage of debris through said void and onto said bottom plate upper face.

6. The dredge as claimed in claim 5 further comprising a side wall extending upwardly from said bottom plate.

* * * * *